US010207842B1

(12) United States Patent
Sullivan et al.

(10) Patent No.: US 10,207,842 B1
(45) Date of Patent: Feb. 19, 2019

(54) ANIMATED TOY BOX ASSEMBLY

(71) Applicants: Sara Sullivan, McMinnville, OR (US); Chris Mikhelotti, McMinville, OR (US)

(72) Inventors: Sara Sullivan, McMinnville, OR (US); Chris Mikhelotti, McMinville, OR (US)

( * ) Notice: Subject to any disclaimer, the term of this patent is extended or adjusted under 35 U.S.C. 154(b) by 0 days.

(21) Appl. No.: 15/678,202

(22) Filed: Aug. 16, 2017

(51) Int. Cl.
*B65D 1/22* (2006.01)
*B65D 43/16* (2006.01)
*B65D 43/26* (2006.01)
*A63H 5/00* (2006.01)

(52) U.S. Cl.
CPC ..... *B65D 43/163* (2013.01); *B65D 1/22* (2013.01); *B65D 43/26* (2013.01); *A63H 5/00* (2013.01); *B65D 2215/02* (2013.01)

(58) Field of Classification Search
None
See application file for complete search history.

(56) References Cited

U.S. PATENT DOCUMENTS

D245,228 S 8/1977 Gilson et al.
4,103,455 A 9/1978 Silvey
4,200,197 A * 4/1980 Meyer ..... A63H 33/00 220/263
4,460,105 A * 7/1984 Cox ..... E05C 17/38 217/60 C
5,376,038 A * 12/1994 Arad ..... A63H 3/28 446/297
6,707,777 B1 3/2004 Cherry
7,165,289 B1 1/2007 Gossage
D734,031 S 7/2015 Gallet
9,844,733 B1 * 12/2017 Veira ..... A63H 3/005
2006/0091036 A1 * 5/2006 Casella ..... A45C 9/00 206/457
2008/0135437 A1 * 6/2008 Taneri ..... A45D 34/00 206/459.1
2008/0237252 A1 * 10/2008 Elefante ..... E05D 3/022 220/811
2008/0287033 A1 * 11/2008 Steinberg ..... A63H 3/28 446/297

(Continued)

FOREIGN PATENT DOCUMENTS

WO WO9108964 6/1991

OTHER PUBLICATIONS

Smart ToyBox, Smart Toybox, Jul. 29, 2016, https://web.archive.org/web/20160729170725/http://smarttoybox.com/ , pp. 1-7.*

(Continued)

*Primary Examiner* — Tramar Harper

(57) ABSTRACT

An animated toy box assembly for stimulating a child to put away toys includes a box that may contain toys. A lid is hingedly coupled to the box such that the lid selectively closes the box. A pair of eyes is coupled to the lid to resemble monster eyes. An interaction unit is coupled to the box and the interaction unit selectively emits audible sound. The interaction unit detects motion thereby detecting when toys are positioned in the box. Moreover, the interaction unit emits the audible sound when the interaction unit detects motion. In this way the interaction unit stimulates a child to place toys in the box.

6 Claims, 4 Drawing Sheets

(56) References Cited

U.S. PATENT DOCUMENTS

| | | | | |
|---|---|---|---|---|
| 2010/0155269 | A1* | 6/2010 | Sosalla | B65D 79/00 206/216 |
| 2011/0053452 | A1* | 3/2011 | Akkad | A63H 3/005 446/73 |
| 2011/0065352 | A1* | 3/2011 | Hogan | A63H 5/00 446/77 |
| 2011/0189919 | A1* | 8/2011 | Rajadhyaksha | A63H 33/04 446/75 |
| 2012/0043717 | A1* | 2/2012 | Carris | A63F 9/10 273/157 R |
| 2014/0374300 | A1* | 12/2014 | Espinosa | B65F 1/163 206/457 |

OTHER PUBLICATIONS

Smart Toybox, Smart Toybox Demonstration, Sep. 22, 2016, https://www.youtube.com/watch?v=SOZs5RVndgk , p. 1.*
My DIY, Storage Chest/Trunk, Jan. 14, 2016, https://www.youtube.com/watch?v=oF9-QwzblpQ , p. 1.*

* cited by examiner

ANIMATED TOY BOX ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to toy box devices and more particularly pertains to a new toy box device for encouraging a child to put away toys.

BRIEF SUMMARY OF THE INVENTION

An embodiment of the disclosure meets the needs presented above by generally comprising a box that may contain toys. A lid is hingedly coupled to the box such that the lid selectively closes the box. A pair of eyes is coupled to the lid to resemble monster eyes. An interaction unit is coupled to the box and the interaction unit selectively emits audible sound. The interaction unit detects motion thereby detecting when toys are positioned in the box. Moreover, the interaction unit emits the audible sound when the interaction unit detects motion. In this way the interaction unit stimulates a child to place toys in the box.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
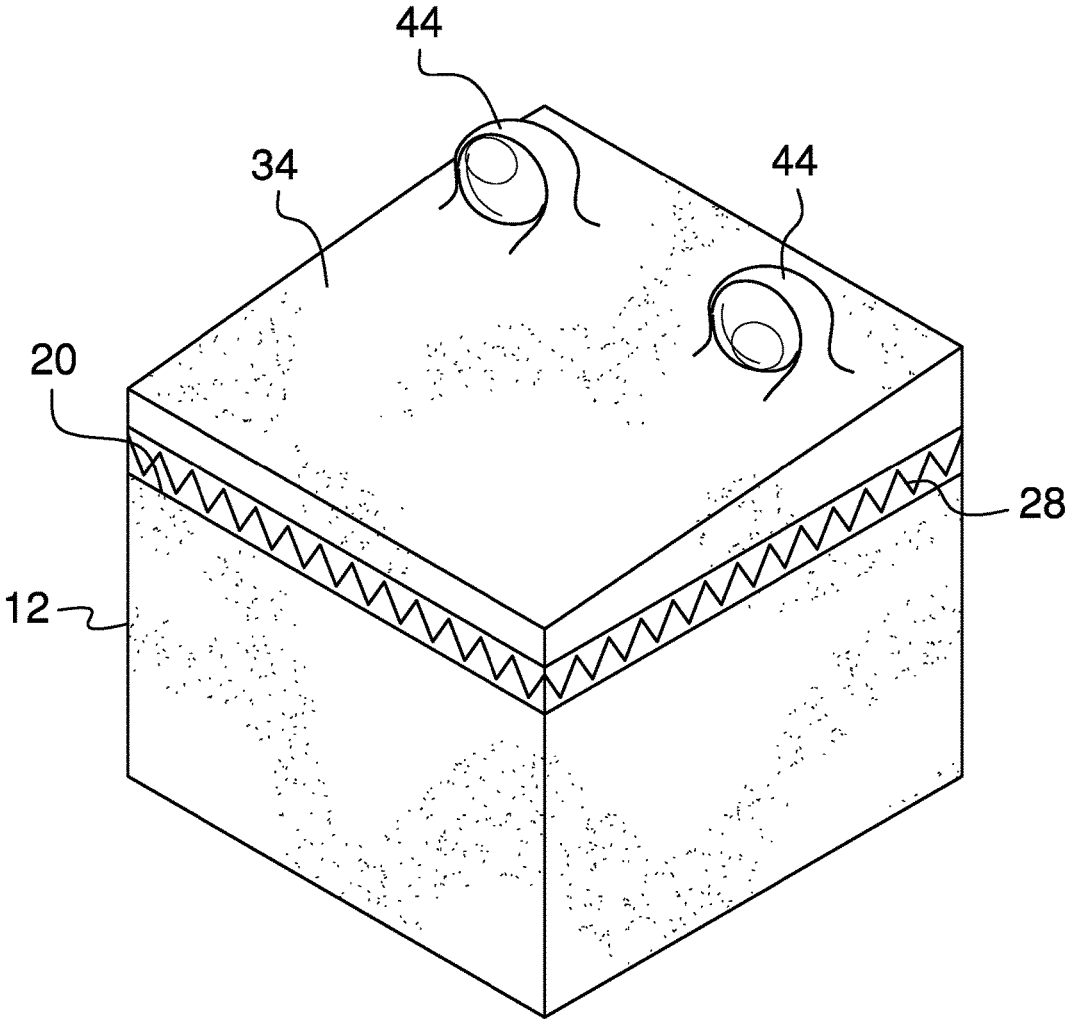
FIG. 1 is a top perspective view of an animated toy box assembly according to an embodiment of the disclosure.
Figure 2:
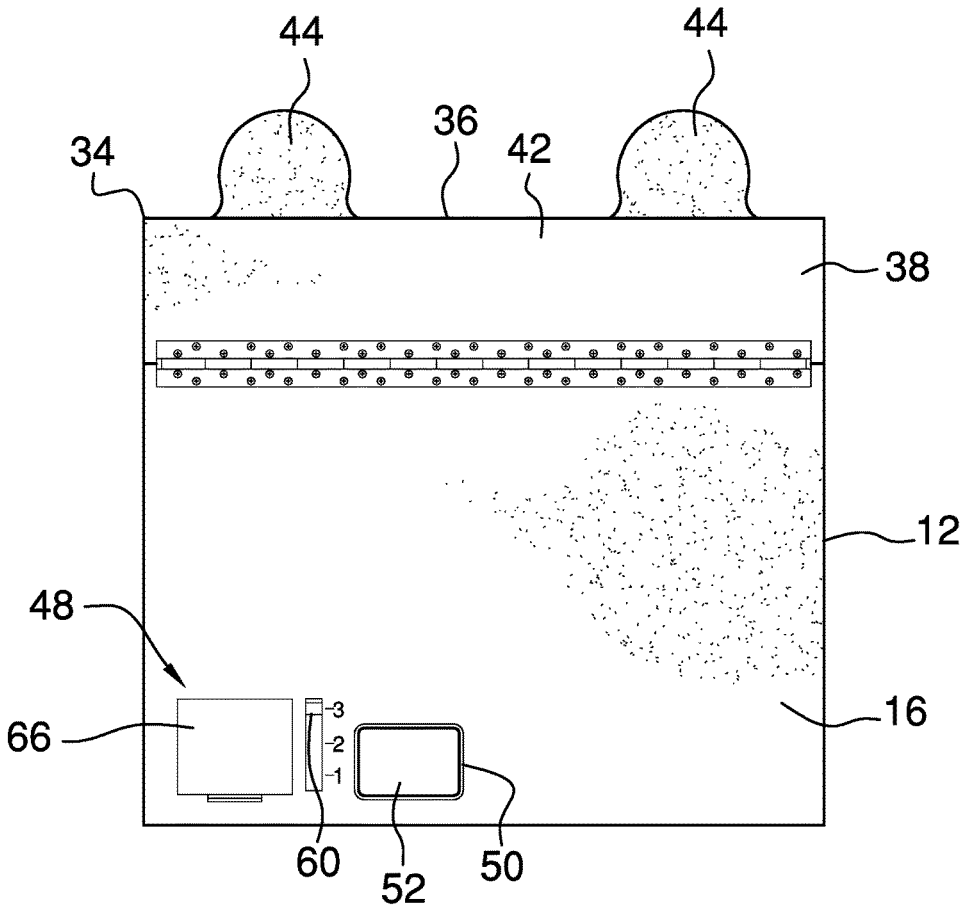
FIG. 2 is a back view of an embodiment of the disclosure.
Figure 3:
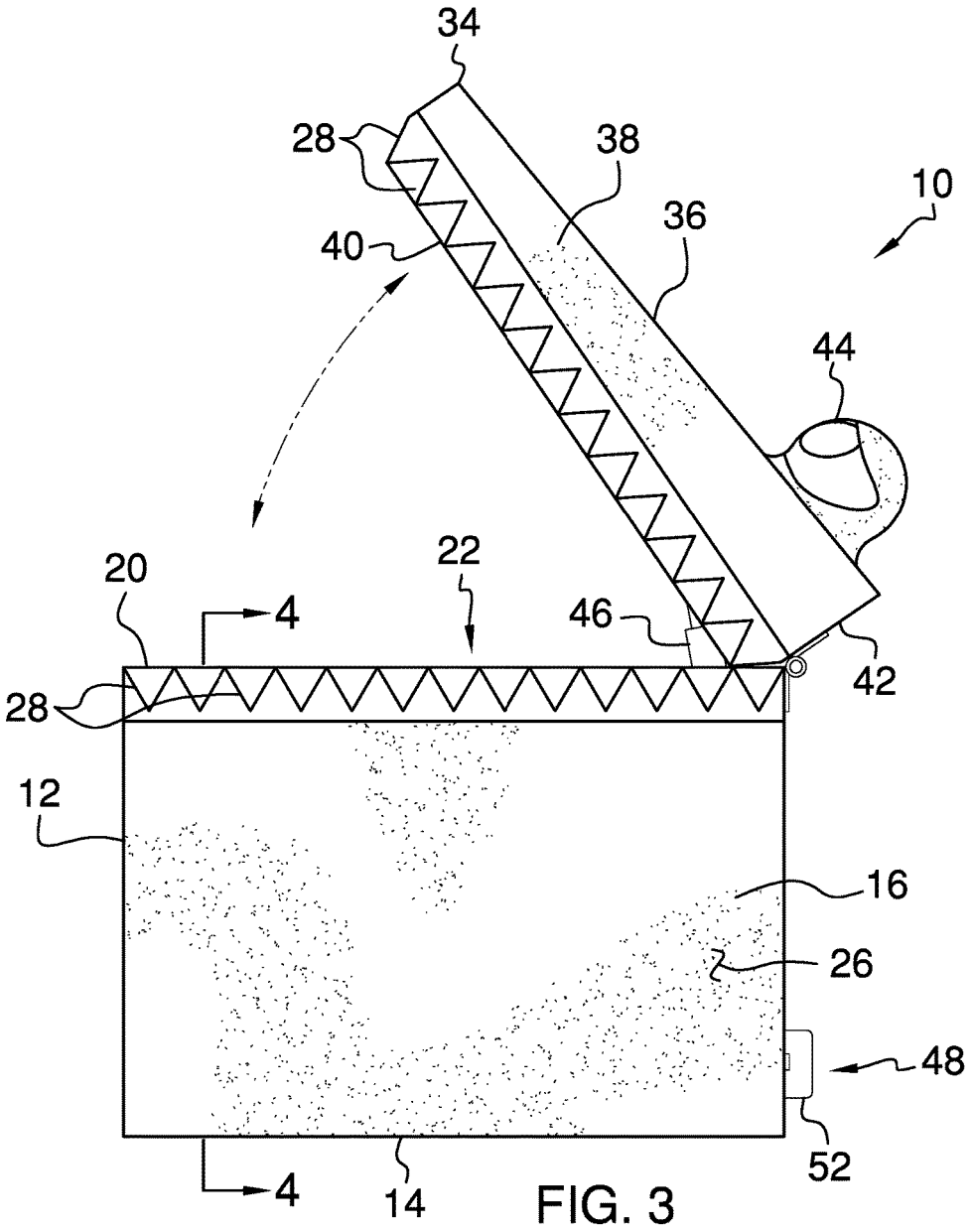
FIG. 3 is a left side view of an embodiment of the disclosure.
Figure 4:
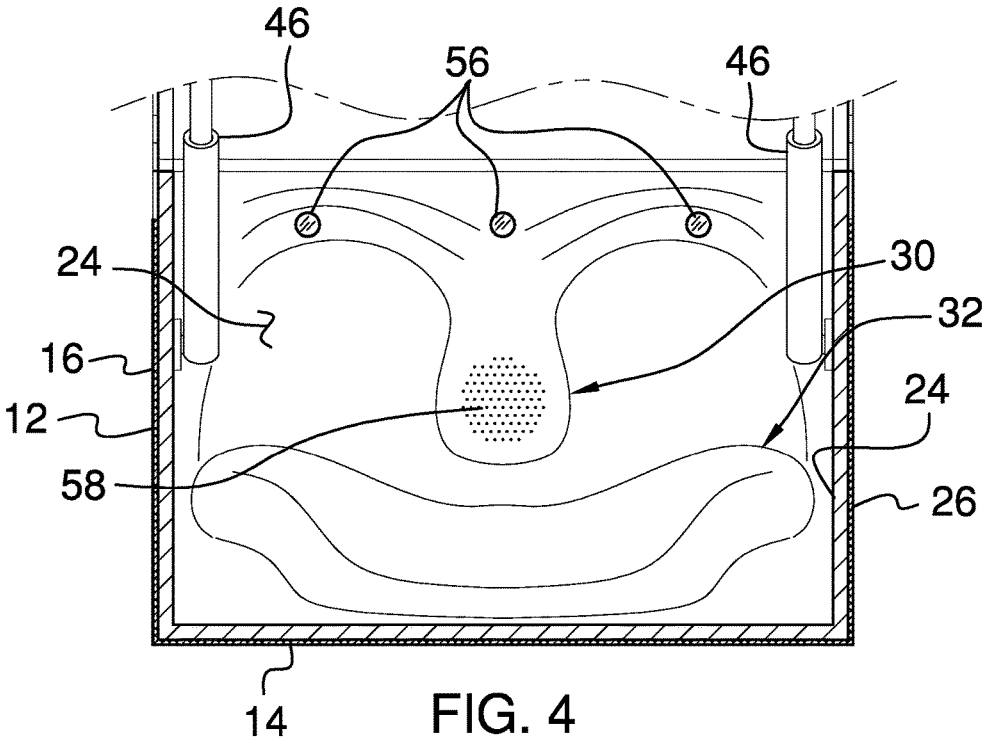
FIG. 4 is a cross sectional view taken along line 4-4 of FIG. 3 of an embodiment of the disclosure.
Figure 5:
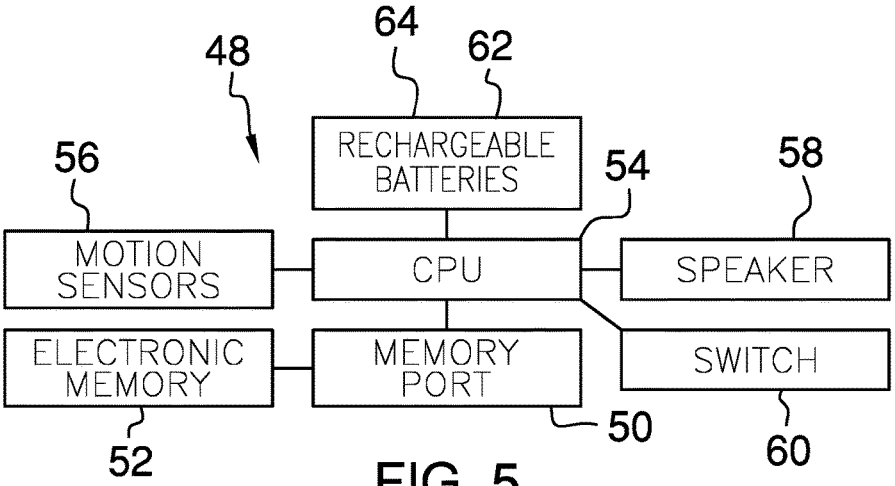
FIG. 5 is a schematic view of an embodiment of the disclosure.

With reference now to the drawings, and in particular to FIGS. 1 through 5 thereof, a new toy box device embodying the principles and concepts of an embodiment of the disclosure and generally designated by the reference numeral 10 will be described.

As best illustrated in FIGS. 1 through 5, the animated toy box assembly 10 generally comprises a box 12 that may contain toys. The box 12 may be positioned in a child's bedroom or the like for storing the toys and any other object. The box 12 has a bottom wall 14 and an outer wall 16 extending upwardly therefrom. The bottom wall 14 is on a support surface 18 and the outer wall 16 is coextensive with a perimeter of the bottom wall 14. The outer wall 16 has a distal edge 20 with respect to the bottom wall 14 to define an opening 22 into the box 12, an inside surface 24 and an outside surface 26.

A row of teeth 28 may be painted on the outside surface 26 of the box 12 along the distal edge 20. Fabric or other tactile material may be wrapped around the box 12 to encourage the child to touch the box 12. Moreover, the box 12 and the fabric may have vibrant colors to enhance visual appeal of the box 12. An image of uvula 30 and an image of a tongue 32 may each be printed on the inside surface 24 of the box 12 to resemble a throat.

A lid 34 is hingedly coupled to the box 12 such that the lid 34 selectively closes the box 12. The lid 34 has a top wall 36 and an exterior wall 38 extending downwardly therefrom. The exterior wall 38 has a distal edge 40 with respect to the top wall 36 and a back side 42. The distal edge 40 corresponding to the back side 42 is hingedly coupled to the distal edge 20 of the box 12 and the top wall 36. Additionally, the top wall 36 may slope downwardly from the back side 42. A pair of eyes 44 is coupled to the box 12 and each of the eyes 44 is coupled to the lid 34. Each of the eyes 44 is structured to resemble monster eyes. A row of teeth 28 may be printed on the exterior wall 38 of the lid 34 along the distal edge 40 of the lid 34. Thus, the lid 34 and the box 12 have the appearance of a monster opening its mouth to swallow the toys.

A plurality of biasing members 46 is provided and each of the biasing members 46 is coupled between the box 12 and the lid 34. Each of the biasing members 46 biases the lid 34 into an open position. In this way the biasing members 46 inhibit the lid 34 from inadvertently closing on fingers. Each of the biasing members 46 may be pneumatic pistons or the like.

An interaction unit 48 is coupled to the box 12 and the interaction unit 48 selectively emits audible sound. The interaction unit 48 detects motion to detect when toys are positioned in the box 12. Moreover, the interaction unit 48 emits the audible sound when the interaction unit 48 detects motion. In this way the interaction unit 48 stimulates a child to place toys in the box 12.

The interaction unit 48 comprises a memory port 50 that is coupled to the outer wall 16 of the box 12. An electronic memory 52 is removably positioned in the memory port 50. The electronic memory 52 may be a memory card or the like and the memory port 50 may be a card reader. The electronic memory 52 stores data pertaining to audible sounds.

The data comprise a first data set, a second data set and a third data set. The audible sounds may include the sound of objects being chewed and swallowed. Additionally, the audible sounds may include corresponding verbal phrases. The verbal phrases may be multiplication tables, spelling and other educational material. The verbal phrases corresponding to each of the first, second and third data sets may correspond with various stages of elementary education.

A processor 54 is coupled to the box 12 and the processor 54 selectively generates an action sequence. The processor 54 is electrically coupled to the memory port 50 such that the processor 54 receives the data from the electronic memory 52. Moreover, the processor 54 may be an electronic processor 54 or the like. A plurality of motion sensors 56 is coupled to the box 12 and the motion sensors 56 senses motion. The motion sensors 56 is positioned on the inside surface 24 of the outer wall 16 of the box 12 to detect toys falling into the box 12. Each of the motion sensors 56 is electrically coupled to the processor 54 and the processor 54 generates the action sequence when the motion sensors 56 sense motion. Each of the motion sensors 56 may be an electronic motion sensor 56 such as an infra red motions sensor or the like.

A speaker 58 is coupled to the box 12 to emit audible sound. The speaker 58 is electrically coupled to the processor 54 such that the speaker 58 emits the audible sounds corresponding to the data in the electronic memory 52. The speaker 58 may be positioned on the inside surface 24 of the box 12 and the speaker 58 may be an electronic speaker.

A switch 60 is slidably coupled the outside surface 26 of the box 12 and the switch 60 is selectively manipulated. The switch 60 is selectively positioned in a first position, a second position and a third position and the switch 60 is electrically coupled to the processor 54. The speaker 58 emits the audible sound corresponding to the first data set when the switch 60 is in the first position. The speaker 58 emits the audible sound corresponding to the second data set when the switch 60 is in the second position. Additionally, the speaker 58 emits the audible sound corresponding to the third data set when the switch 60 is in the third position.

A power supply 62 is coupled to the box 12 and the power supply 62 is electrically coupled to the processor 54. The power supply 62 comprises at least one battery 64. A battery cover 66 may be removably coupled to the box 12 and the power supply 62 may be positioned under the battery cover 66.

In use, the box 12 is placed in a child's bedroom, playroom and any other location with a plurality of toys. The lid 34 is selectively opened to place the toys in the box 12. The motion sensor 56 senses the motion of the toys as they are dropped, thrown and otherwise deposited into the box 12. The processor 54 generates the action sequence and the speaker 58 emits the audible sound. In this way the child is encouraged to continue depositing the toys in the box 12. Each of the biasing members 46 inhibits the lid 34 from accidentally closing on the child's fingers. The lid 34 is selectively closed by an adult pushing down firmly on the lid 34.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. An animated toy box assembly being configured to interact with a user, said assembly comprising:

a box being configured to contain toys;

a lid being hingedly coupled to said box such that said lid selectively closes said box;

a pair of eyes, each of said eyes being coupled to said lid wherein said pair of eyes is configured to resemble monster eyes; and an interaction unit being coupled to said box wherein said interaction unit is configured to selectively emit audible sound, said interaction unit detecting motion wherein said interaction unit is configured to detects toys being positioned in said box, said interaction unit emitting the audible sound when said interaction unit detects motion wherein said interaction unit is configured to stimulate a child to place toys in said box, said interaction unit comprising a memory port being coupled to said box, an electronic memory being removably positioned in said memory port, said electronic memory storing data pertaining to audible sounds, said data comprising a first data set, a second data set and a third data set, a processor being coupled to said box, said processor selectively generating an action sequence, said processor being electrically coupled to said memory port such that said processor receives said data from said electronic memory, a speaker being coupled to said box wherein said speaker is configured to emit audible sound, said speaker being electrically coupled to said processor such that said speaker emits the audible sounds corresponding to said data in said electronic memory, a switch being slidably coupled said outside surface of said box wherein said switch is configured to be manipulated, said switch being selectively positioned in a first position, a second position and a third position, said switch being electrically coupled to said processor, said speaker emitting the audible sound corresponding to said first data set when said switch is in said first position, said speaker emitting the audible sound corresponding to said second data set when said switch is in said second position, said speaker emitting the audible sound corresponding to said third data set when said switch is in said third position, and a power supply being coupled to said box, said power supply being electrically coupled to said processor, said power supply comprising at least one battery.

2. The assembly according to claim 1, wherein said box has a bottom wall and an outer wall extending upwardly therefrom, said bottom wall being configured to be positioned on a support surface, said outer wall being coextensive with a perimeter of said bottom wall, said outer wall having a distal edge with respect to said bottom wall to define an opening into said box, said outer wall having an inside surface and an outside surface.

3. The assembly according to claim 2, wherein said lid has a top wall and an exterior wall extending downwardly therefrom, said exterior wall having a distal edge with respect to said top wall and a back side, said distal edge corresponding to said back side being hingedly coupled to said distal edge of said box, said top wall having an outer surface.

4. The assembly according to claim 3, further comprising a plurality of biasing members, each of said biasing members being coupled between said box and said lid, each of said biasing members biasing said lid into an open position wherein said biasing members are configured to inhibit said lid from inadvertently closing on fingers.

5. The assembly according to claim 1, further comprising a motion sensor being coupled to said box wherein said motion sensor is configured to sense motion, said motion sensor being positioned on an inside surface of an outer wall of said box wherein said motion sensor is configured to detect toys falling into said box, said motion sensor being electrically coupled to said processor, said processor generating said action sequence when said motion sensor senses motion.

6. An animated toy box assembly being configured to interact with a user, said assembly comprising:

a box being configured to contain toys, said box having a bottom wall and an outer wall extending upwardly therefrom, said bottom wall being configured to be positioned on a support surface, said outer wall being coextensive with a perimeter of said bottom wall, said outer wall having a distal edge with respect to said bottom wall to define an opening into said box, said outer wall having an inside surface and an outside surface;

a lid being hingedly coupled to said box such that said lid selectively closes said box, said lid having a top wall and an exterior wall extending downwardly therefrom, said exterior wall having a distal edge with respect to said top wall and a back side, said distal edge corresponding to said back side being hingedly coupled to said distal edge of said box, said top wall having an outer surface;

a pair of eyes, each of said eyes being coupled to said lid wherein said pair of eyes is configured to resemble monster eyes;

a plurality of biasing members, each of said biasing members being coupled between said box and said lid, each of said biasing members biasing said lid into an open position wherein said biasing members are configured to inhibit said lid from inadvertently closing on fingers; and an interaction unit being coupled to said box wherein said interaction unit is configured to selectively emit audible sound, said interaction unit detecting motion wherein said interaction unit is configured to detects toys being positioned in said box, said interaction unit emitting the audible sound when said interaction unit detects motion wherein said interaction unit is configured to stimulate a child to place toys in said box, said interaction unit comprising:

a memory port being coupled to said box, an electronic memory being removably positioned in said memory port, said electronic memory storing data pertaining to audible sounds, said data comprising a first data set, a second data set and a third data set, a processor being coupled to said box, said processor selectively generating an action sequence, said processor being electrically coupled to said memory port such that said processor receives said data from said electronic memory, a motion sensor being coupled to said box wherein said motion sensor is configured to sense motion, said motion sensor being positioned on said inside surface of said outer wall of said box wherein said motion sensor is configured to detect toys falling into said box, said motion sensor being electrically coupled to said processor, said processor generating said action sequence when said motion sensor senses motion, a speaker being coupled to said box wherein said speaker is configured to emit audible sound, said speaker being electrically coupled to said processor such that said speaker emits the audible sounds corresponding to said data in said electronic memory, a switch being slidably coupled said outside surface of said box wherein said switch is configured to be manipulated, said switch being selectively positioned in a first position, a second position and a third position, said switch being electrically coupled to said processor, said speaker emitting the audible sound corresponding to said first data set when said switch is in said first position, said speaker emitting the audible sound corresponding to said second data set when said switch is in said second position, said speaker emitting the audible sound corresponding to said third data set when said switch is in said third position, and a power supply being coupled to said box, said power supply being electrically coupled to said processor, said power supply comprising at least one battery.

* * * * *